US006072138A

United States Patent [19]

Sato

[11] Patent Number: 6,072,138

[45] Date of Patent: Jun. 6, 2000

[54] SLIDING SWITCH CONTACT STRUCTURE

[75] Inventor: Shunichi Sato, Tokyo, Japan

[73] Assignee: Niles Parts Co., Ltd., Tokyo, Japan

[21] Appl. No.: 09/021,857

[22] Filed: Feb. 11, 1998

[30] Foreign Application Priority Data

Feb. 14, 1997 [JP] Japan ..... 9-044895

[51] Int. Cl.[7] ..... H01H 15/06

[52] U.S. Cl. ..... 200/550; 200/263

[58] Field of Search ..... 200/61.88, 61.91, 200/547, 548, 549, 550, 263, 266

[56] References Cited

U.S. PATENT DOCUMENTS

| | | | |
|---|---|---|---|
| 3,779,714 | 12/1973 | Nadkarni et al. | 29/182.5 |
| 3,969,278 | 7/1976 | Aksenov et al. | 252/513 |
| 4,152,565 | 5/1979 | Rose | 200/548 |
| 4,369,424 | 1/1983 | Miyamoto | 200/550 X |
| 4,999,336 | 3/1991 | Nadkarni et al. | 505/1 |
| 5,231,254 | 7/1993 | Baker et al. | 200/61.91 |
| 5,338,618 | 8/1994 | Suzuki et al. | 200/266 X |
| 5,351,396 | 10/1994 | Sawada et al. | 229/885 |
| 5,860,515 | 1/1999 | Tomotoshi | 200/550 |

FOREIGN PATENT DOCUMENTS

S63-213221 9/1988 Japan .

*Primary Examiner*—Renee S. Luebke

*Attorney, Agent, or Firm*—Ronald P. Kananen; Rader, Fishman & Grauer

[57] ABSTRACT

A sliding switch contact structure that has a movable contact and a fixed contact which are formed of a stainless steel, an Fe—Ni alloy, an Fe—Ni—Co alloy, or an Fe—Ni—Cr alloy. With such structure, a contact material is provided that is usable in a slide switch operating in high temperature oil contained within a transmission, an engine or a brake hydraulic system of an automotive vehicle.

4 Claims, 3 Drawing Sheets

SLIDING SWITCH CONTACT STRUCTURE

BACKGROUND OF THE INVENTION

1. Field of the Invention

The present invention relates generally to a structure of a sliding switch contact and, in particular, to a contact structure adapted for a sliding switch that is used in high-temperature oil.

2. Description of the Related Art

Switch contacts are conventionally made of copper alloys, which are excellent in electric characteristics and springiness. A conventional switch contact is disclosed, for example, by Japanese Unexamined Patent Publication No. S63-213221, wherein a copper alloy of a sheet material is employed to increase the mechanical strength for the switch contact. This conventional switch contact uses a technique wherein a spring alloy at its respective surfaces is superposed by a copper alloy to be subjected to roll working.

However, although the conventional copper switch contact possesses excellent properties as stated hereinbefore at room temperatures, there is a problem in that the switch contact loses its function of contact under temperatures conditions ranging from −40° C. to 180° C. in an oil within a vehicular transmission, an engine, a brake oil-pressure system, or the like. If copper or copper alloy is used as a slide contact under the aforesaid environment, insulating compounds, such as copper oxides and sulfides, are produced over the surface thereof in a short period of time and thereby cause a problem of electrical disconnection.

SUMMARY OF THE INVENTION

It is an object of the present invention to provide a switch contact material that solves the problems associated with the conventional switch contact structure described above.

More specifically, it is the object of the present invention to provide a contact material for a sliding switch contact that is usable in a high-temperature oil contained within a transmission, an engine or a brake hydraulic system of an automotive vehicle.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a structure of a sliding switch contact comprises: a movable contact 2 and a fixed contact 11 which are formed of a stainless steel, an Fe—Ni alloy, an Fe—Ni—Co alloy, or an Fe—Ni—Cr alloy.

The movable contact 2 is preferably formed higher in hardness than the fixed contact. The movable contact is also preferably formed of a stainless steel, and the fixed contact is preferably formed of an Fe—Ni alloy, an Fe—Ni—Co alloy, or an Fe—Ni—Cr alloy.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A slide switch structure according to the present invention will now be described in detail with reference to FIGS. 1 to 5 of the accompanying drawings.

Figure 1:
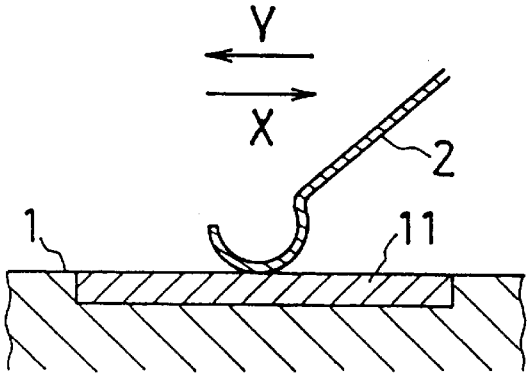
FIG. 1 is an explanatory view showing a preferred embodiment of the present invention.

As shown in FIG. 1, a base board 1 is formed of a heat resistive resin and is insert-formed with a fixed contact 11. The fixed contact 11 is formed of an Fe-based alloy that is lower in hardness than a movable contact 2. The Fe-based alloy for the fixed contact 11 is, for example, a stainless steel, an Fe—Ni alloy, an Fe—Ni—Co alloy, an Fe—Ni—Cr alloy, or the like. There are no special limitations in the shape of the fixed contact 11 according to the present invention.

The movable contact 2 is a sliding switch contact piece that is formed of an Fe alloy higher in hardness than the fixed contact 11. The movable contact 2 is arranged for slide movement in directions of the arrows X and Y. The movable contact 2 is formed of an Fe-based alloy, such as a stainless steel, an Fe—Ni alloy, an Fe—Ni—Co alloy, an Fe—Ni—Cr alloy, or the like.

For example, where the movable contact 2 is formed of a stainless steel, the fixed contact 11 is formed, for example, of an Fe—Ni alloy, an Fe—Ni—Co alloy, or an Fe—Ni—Cr alloy.

The preferred embodiment of the present invention is structured as described above, and the operation thereof will now be explained.

The movable contact 2 and the fixed contact 11 are of an Fe-based alloy, such as, for example, a stainless steel, an Fe—Ni alloy, an Fe—Ni—Co alloy, an Fe—Ni—Cr alloy, or the like. The Fe-based alloy is heat-resistant and excellent in chemical stability as compared to Cu or Cu alloys. The Fe-based alloy will not produce insulating compounds even when placed within a high-temperature oil. Thus, the Fe-based alloy can continue to function as a manually operated contact over a long term.

The movable contact 2 is of an Fe-based alloy which is increased in hardness higher than the fixed contact 11. Due to this, the fixed contact 11 is cut away by a constant amount as the number of slide movements increases, thereby providing a stable cut surface. The movable contact 2, in turn, has increased electrical stability during its sliding motion.

The movable contact 2 formed of a stainless steel has a high property of a compound film (passivity) formed over the surface thereof, thereby making it chemically stable. If the passivity film at the surface of the movable contact 2 is cut away, a new film is again formed, thereby keeping resistance to an outside environment.

The fixed contact 11 formed of an Fe—Ni alloy contains a large amount of Ni and, accordingly, is chemically stable.

The fixed contact 11 has no difference in composition of material between the surface and the internal thereof. Thus, the contact 11 will not deteriorate in chemical stability despite being cut by the sliding of the movable contact 2.

Therefore, the movable contact 2 and the fixed contact 11 are best suited for contacts for a sliding switch that is used in a high-temperature oil within a vehicular transmission, an engine, a brake hydraulic system, or the like.

Explanations will now be made in detail for an example according to the present invention with reference to FIGS. 2 to 5 of the accompanying drawings. The example is on a sliding switch used in a state of being submerged in an oil of an automatic transmission for automotive vehicles.

Figure 3:
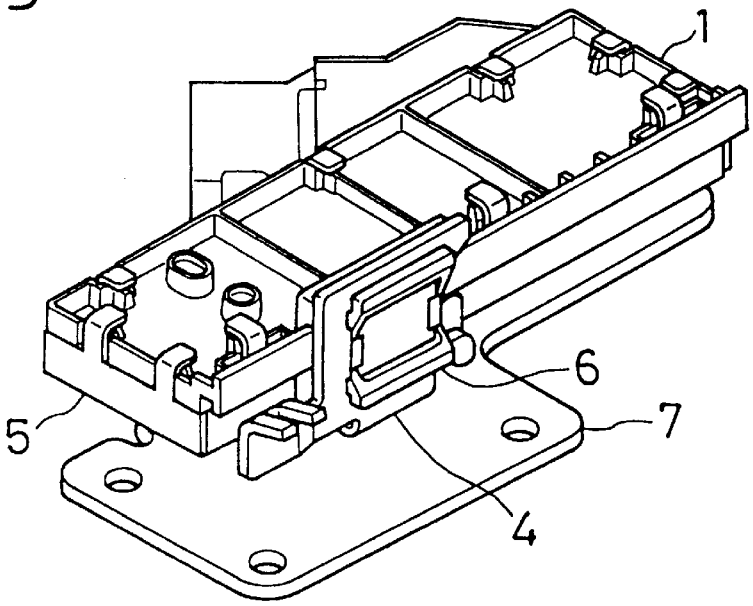
FIG. 3 is a perspective view of a switch according to the present invention.
Figure 4:
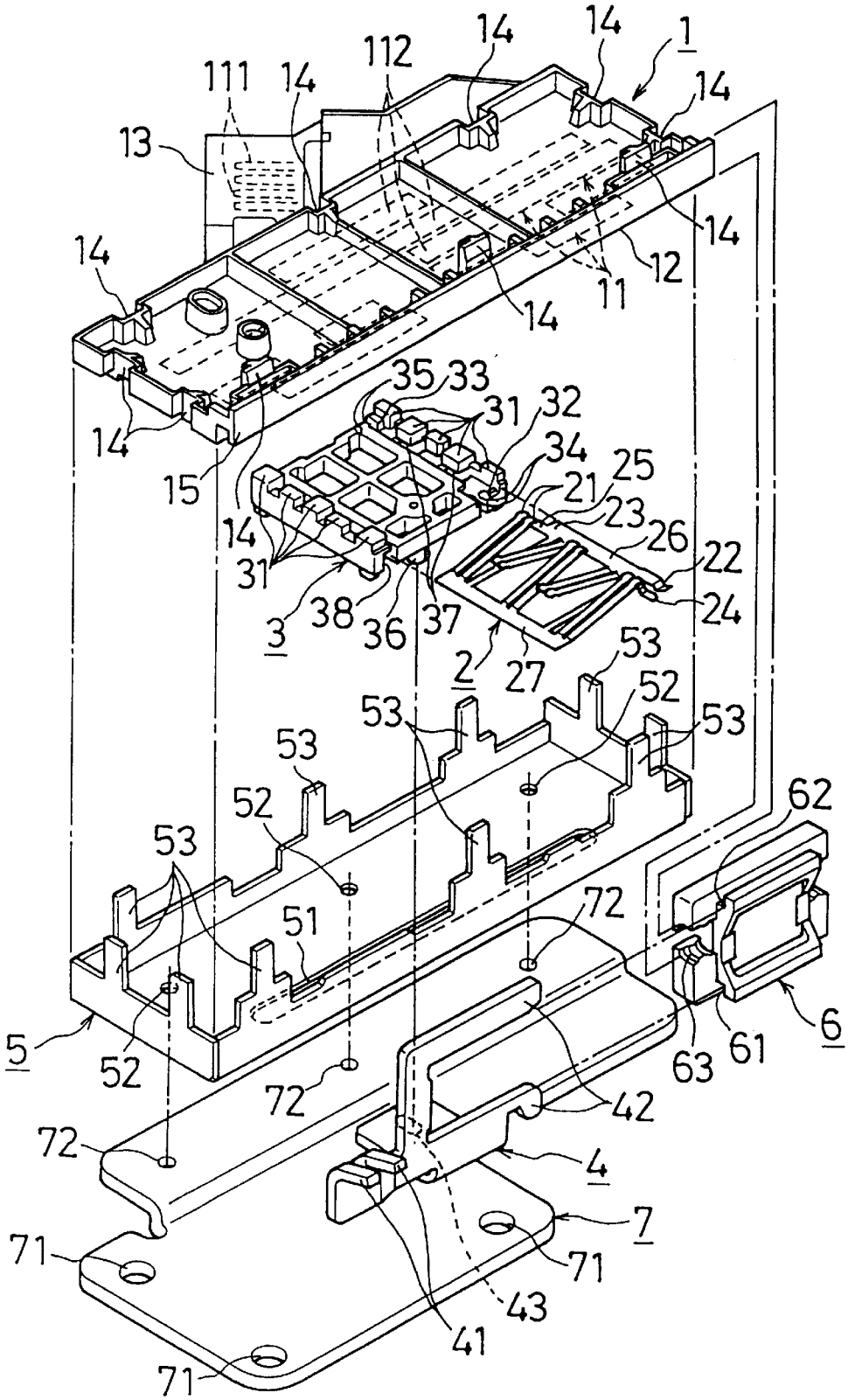
FIG. 4 is an exploded perspective view of the switch according to the present invention.

In FIGS. 3 and 4, a base board 1 formed of a synthetic resin is shown. The base board 1 is heat-resisting and oil-resisting to withstand in use being submerged in a high-temperature oil in an automatic transmission for automotive vehicles. The base board 1 is insert-formed with a fixed contact 11 and a terminal 111 in connection to the fixed contact 11.

The base board 1, as shown in FIG. 4, is provided at a back side thereof with rows of contact portions 112 of the fixed contact 11 over which the movable contact 2 slides. The base board 1 has wall-shaped projections (not shown) formed along the contact portions 112 and between the contact portions 112 juxtaposed, for example, in five rows. The projections have dual functions to enhance insulating property as well as guide the projections 31 of a movable board 3 to allow the movable contacts 21 to move straightly.

The base board 1 has a connector 13 formed in one body therewith, so that the terminal 111 in electrical connection to the fixed contact 11 projects toward the inside of the connector 13. The base board 1 is provided with clinch portions 14 at several points on an outer periphery thereof. The clinch portions 14 are portions over which clinch pieces 53 of a frame member 5 are respectively clinched.

Figure 2:
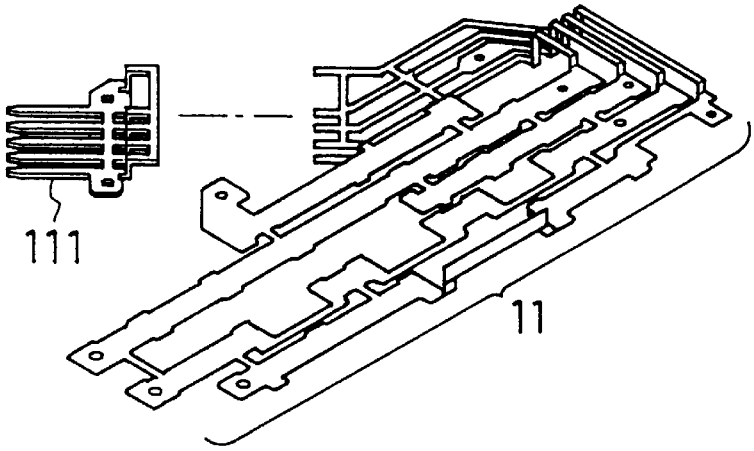
FIG. 2 is an exploded perspective view showing a shape of a fixed contact prior to separating into contact portions and terminals, according to the present invention.

The fixed contact 11 and the terminal 111 are formed, as stated above, of an Fe-based alloy, such as, for example, a stainless steel, an Fe—Ni alloy, an Fe—Ni—Co alloy, an Fe—Ni—Cr alloy, or the like. The fixed contact 11 and the terminal 111 are formed by dividing one metal sheet into two, as shown in FIG. 2, each of which is further press-worked in order into a plurality of sheets.

The movable contact 2 is a sliding piece formed, as stated above, of an Fe-based alloy, such as, for example, a stainless steel, an Fe—Ni alloy, an Fe—Ni—Co alloy, an Fe—Ni—Cr alloy, or the like. The movable contact 2 is worked by press-blanking and bending from one metal sheet. The movable contact 2 has five sets of contact pieces 21, chatter-preventing pieces 22, 23, 24, 25, and leadframes 26, 27.

The movable contact 2, as shown in FIG. 4, is a contact sheet for the contact switch that has a plurality of pairs of the contact pieces 21 alternately projected in different directions from the left and right of the leadframes 26, 27. The movable contact 2 is formed generally in a quadrilateral shape. The movable contact 2 is held by the movable board 3 by inserting its leadframes 26, 27 into gaps 37 formed at an underside of L-shaped protrusions 31 projected at opposite edges of the movable board 3.

The contact pieces 21 are each formed by a pair of adjacent tongue pieces so that the number thereof is the same as that of the contact portions 112 of the fixed contact 11. Each contact piece 21 is curved toward the fixed contact 11 to have elasticity. The chatter-preventing pieces 22, 23, 24, 25 are provided at ends of the leadframe 26 correspondingly to step portions 32, 33 and engaging portions 34, 35, so that the movable contact 2 is assembled onto the movable board in a one-touch manner by engaging the chattering-preventing pieces with the step portions 32, 33 and the engaging portions 34, 35.

The movable board 3 is formed of a synthetic resin to have the protrusions 31 for wiping over the surface of the fixed contact 11. The gaps 37 of the movable board 3 extend in a direction rectangular to the direction of slide movement thereof so as to receive therein the movable contact 2 from the rectangular direction. The movable board 3 also has the step portions 32, 33 formed in an extension of the gaps 37, and the engaging portions 34, 35 formed in a valley-like form in section. The movable board 3 is further insert-formed with a metallic pin 36 for engagement with an operating member 4.

Now explanations will be made on the procedure for assembling the movable contact 2 onto the movable board in a one-touch manner. First, the leadframes 26, 27 are inserted into the gaps 37, 38 from the side of the chatter-preventing pieces 23, 24, as shown in FIG. 4. When inserting by a certain amount, the chatter-preventing piece 23 comes into abutment against the step portion 33 to block the movable contact 2 from moving further forwardly.

At this time, the chatter-preventing piece 22, positioned at the opposite side to the chatter-preventing piece 23, gets over the step portion 32 to be elastically fitted with the movable board 3. Thus, the movable contact 2 is prevented from chattering in the rectangular direction.

On the other hand, the chatter-preventing pieces 24, 25 are press-contacted with the engaging portions 34, 35 of the movable board 3. Thus, the movable contact 2 is prevented from chattering in the sliding direction.

The operating member 4 has a connecting portion 41 for connection to a manual valve (not shown) of the automatic transmission, an inserting portion 42 over which a guide block 6 is inserted, and an engaging hole 43 with which a pin 36 of the movable board 3 is engaged. The engaging hole 43 is in a hole shape that is formed long in a rectangular direction perpendicular to the direction of movement of the movable board 3.

A frame 5 is a part that has been worked by pressing from a metal plate. The frame 5 has an elongate hole 51 through which the pin 36 of the movable board 3 is inserted, holes 52 provided corresponding to holes 72 of a bracket 7, and clinch pieces 53 for being clinched to the clinch portion 14 of the board 1. The movable board 3 is accommodated within a space defined by the frame 5 and the board 1. The elongate hole 51 has its width dimension somewhat greater than the diameter of the pin 36.

A guide block 6 is a part that is interposed between the operating member 4 and the base board 1 so that the operating member 4 is guided along a rail 15 provided on the board 1. The guide block 6 has insertion grooves 61, 62 in which inserting portions 42 are inserted, and a recess 63 into which the rail 15 is inserted.

The bracket 7 has mounting holes for mounting on a case of the automatic transmission, and holes 72 for attaching to the frame 5, so that the bracket 7 and the frame 5 are fixed by tightening with screws (not shown) through the holes 72 and the holes 52.

The preferred embodiment of the present invention is structured as above. Now explanations will be further made for materials for the movable contact 2 and the fixed contact 11.

The movable contact 2 and the fixed contact 11 are formed of an Fe-based alloy, such as, for example, a stainless steel, an Fe—Ni alloy, an Fe—Ni—Co alloy, an Fe—Ni—Cr alloy, or the like. The movable contact 2 is formed higher in hardness than the fixed contact 11.

Figure 5:
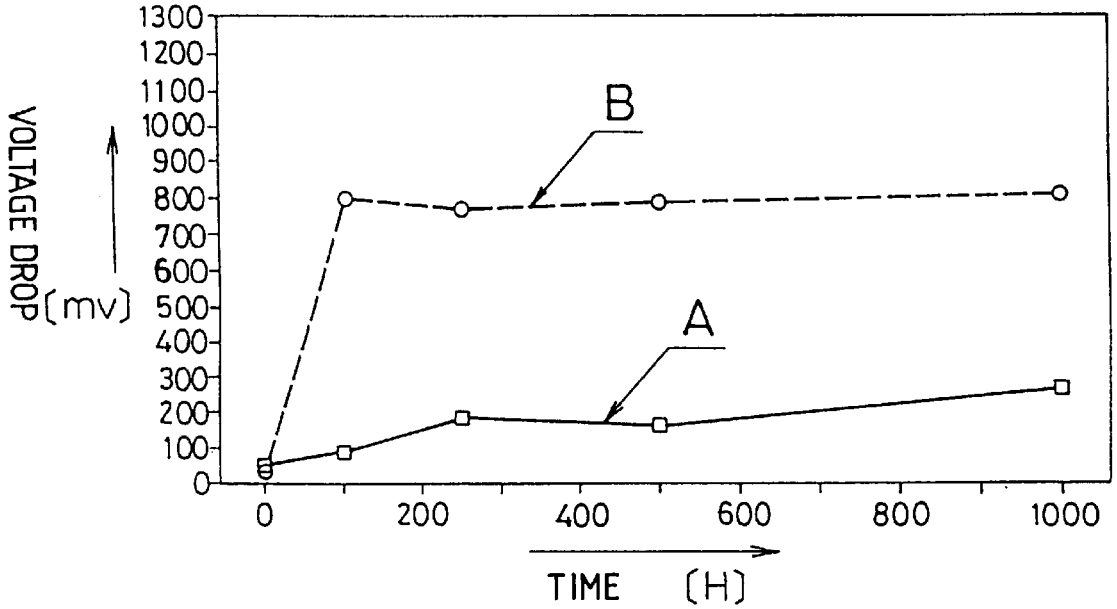
FIG. 5 is a graph showing the comparison in environment-resisting characteristics between the fixed contact and the movable contact of the present invention and the conventional fixed contact and movable contact wherein the relationship between variation in voltage drop and time is shown where the fixed contact and the movable contact, respectively, are immersed in a transmission oil at 150° C.

FIG. 5 is a graph showing the comparison in environment-resisting characteristics between the fixed contact 11 and the movable contact 2 according to the present invention and the conventional fixed contact and movable contact. The abscissa represents time in hours [H], while the ordinate denotes voltage drops in millivolts [mV]. The line A represents data on voltage drops measured by flowing an 800 mA electric current through the fixed contact 11 and the movable contact 2 according to the present invention. The fixed contact 11 and movable contact 2 are respectively formed of a 42Ni—Fe alloy material and an SUS301 material and are submerged in a transmission oil at 150° C. The line B represents data on voltage drops measured by flowing an 800 mA electric current through a fixed contact and a movable contact which are respectively formed of conventionally used oxidation-free and phosphor bronze submerged in a transmission oil at 150° C.

As shown in FIG. 5, the movable contact 2 and the fixed contact 11 are heat-resisting and oil-resisting and, hence, excellent in environment-resisting characteristics as compared to the fixed contact and movable contact of conventional copper and copper-based alloy.

Table 1, shown below, is a comparison table showing data, as to spring property and chemical stability, concerning conventional copper, copper-based alloys, SUS alloys, and Fe—Ni alloys.

TABLE 1

Characteristics of Contact Materials

| Material | Electric resistance vΩ/cm | Young's Modulus kg/mm$^2$ | Spring characteristics | Chemical characteristics |
|---|---|---|---|---|
| Oxygen-free copper | 2 | 11800 | X | X |
| Phosphor copper | 7 | 11000 | ● | X |
| Beryllium copper | 7 | 12500 | ● | X |
| SUS301 | 71 | 19700 | ○ | ● |
| SUS304 | 72 | 19300 | ○ | ● |
| SUS405 | 60 | 20000 | ▲ | ● |
| SUS403 | 57 | 20000 | ▲ | ● |
| 42Ni—Fe | 63 | 13500 | X | ○ |
| 52Ni—16Co—Fe | 43 | — | X | ○ |
| 29Ni—16Cr—Fe | 48 | 14000 | X | ○ |
| 42Ni—06Cr—Fe | 95 | — | X | ○ |

In the material column of Table 1, the numeral described on the left of a chemical symbol Ni, Co or Cr denotes the ratio (weight %) of alloy. The spring property represents whether the material is usable or nonusable as a spring material.

In the material column of Table 1, SUS301 and SUS304 are of austenitic stainless steel. SUS405 is of a ferritic stainless steel. SUS403 is of a martensitic stainless steel. 42Ni—Fe and 52Ni—Fe are nickel steels as electronic materials. 29Ni—16Co—Fe is of a nickel-constantan steel as an electronic material. 42Ni—06Cr—Fe is a nickel-chromium steel as an electronic material.

In the spring characteristic column of Table 1, ● represents that the material is especially excellent as a spring material and a metal in common use. ○ denotes a metal that is commonly used as a spring material. ▲ is a metal not commonly used as a spring material, which is possible to use but requires devising upon usage. X represents a metal impossible to use as a spring material, and is not commonly used.

In the chemical stability column of Table 1, chemical stability for the metal is shown where it has been immersed in a transmission oil at a temperature of 150° C. In the chemical stability column of Table 1, ● represents a metal that is free of occurrence of insulating compounds harmful to switch contacts, and hence particularly excellent. ○ is a metal that produces somewhat insulating compounds harmful to switch contacts, but excellent without problem in use. ▲ denotes a metal possible to use for switch contacts, but requires devising upon usage. X is a metal that produces insulating compounds such as sulfides or the like harmful to switch contacts.

As shown in Table 1, the conventional copper and the copper-based alloys are poor in chemical stability and cannot be used in high-temperature oils. It is revealed that the stainless steels are excellent in chemical stability, with spring characteristic. In particular, it is understood that SUS301 and SUS304 are excellent in chemical stability and spring characteristic, and best suited as a material for the movable contact. Meanwhile, the nickel-based alloy steels are best suited for the fixed contact 11.

The present invention structured as described above provides the following beneficial effects and advantages.

The present invention is characterized by a structure of a sliding switch contact comprising: a movable contact and a fixed contact which are formed of a stainless steel, an Fe—Ni alloy, an Fe—Ni—Co alloy, or an Fe—Ni—Cr alloy. It is therefore possible to provide, at a low cost, a structure of a switch contact for sliding switches that is best suited for use in a high-temperature oil.

The invention is also characterized by a movable contact that is formed higher in hardness than the fixed contact. Therefore, the fixed contact is cut away by an amount proportional to the number of slides of the movable contact over the fixed contact.

The invention is still further characterized by the movable contact 2 being formed of a stainless steel, and the fixed contact 11 being formed of an Fe—Ni alloy, an Fe—Ni—Co alloy or an Fe—Ni—Cr alloy. It is therefore possible to provide a structure of a movable contact and a fixed contact for a sliding switch that is usable in a high-temperature oil in an automotive vehicle transmission, engine, brake hydraulic system, or the like.

It will be appreciated that the present invention is not limited to the exact construction that has been described above and illustrated in the accompanying drawings, and that various modifications and changes can be made without departing from the scope and spirit thereof It is intended that the scope of the invention only be limited by the appended claims.

What is claimed is:

1. A sliding switch apparatus, comprising:

a base board having a plurality of dented clinch portions formed along the periphery, said base board including a rail;

a fixed contact positioned on said base board;

a switching member slidably engaged on said rail of said base board;

a movable board having a plurality of L-shaped protrusions;

a movable contact positioned on said movable board and movably engaged to said fixed contact on said base board, said movable contact including a lead frame having chatter-preventing portions formed thereon, said lead frame engaging said L-shaped protrusions on said movable board and said chatter-preventing portions prevent said movable contact from moving on said movable board; and a frame member having a plurality of clinch pieces formed along the periphery, wherein said switching member is positioned between said base board and said frame member and said plurality of clinch pieces on said frame member is formed to align with said plurality of dented clinch portions on said base board, whereby the frame member and the base board are adapted to be assembled together by clinching said plurality of clinching members to said plurality of clinch portions, and wherein said movable contact and said fixed contact are formed of a material selected from the group consisting of a stainless steel, an Fe—Ni alloy, an Fe—Ni—Co alloy, and an Fe—Ni—Cr alloy.

2. The sliding switch apparatus according to claim 1, Wherein said movable contact is formed of a material higher in hardness than said fixed contact.

3. The sliding switch apparatus according to claim 1, wherein said movable contact is formed of a stainless steel, and said fixed contact is formed of an Fe—Ni alloy.

4. The sliding switch apparatus according to claim 1, wherein said movable contact and said fixed contact are submerged in a high temperature oil.

* * * * *